US007703734B2

(12) United States Patent
Chen et al.

(10) Patent No.: US 7,703,734 B2
(45) Date of Patent: Apr. 27, 2010

(54) SLIDE MOUNTING BRACKET STRUCTURE

(75) Inventors: Ken-Ching Chen, Kaohsiung Hsien (TW); Chien-Li Huang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 292 days.

(21) Appl. No.: 12/005,292

(22) Filed: Dec. 27, 2007

(65) Prior Publication Data

US 2009/0166485 A1 Jul. 2, 2009

(51) Int. Cl.
*A47F 5/00* (2006.01)
*A47H 1/10* (2006.01)

(52) U.S. Cl. ..... 248/298.1; 248/235; 248/241; 248/247; 248/250; 248/225.21; 248/221.11; 248/222.11; 211/26; 211/192; 211/187; 312/351; 312/408; 108/147.11; 108/108

(58) Field of Classification Search ..... 248/235, 248/241, 247, 250, 225.21, 298.1, 221.11, 248/222.11; 211/26, 192, 187; 312/351, 312/408; 10/108, 147.11
See application file for complete search history.

(56) References Cited

U.S. PATENT DOCUMENTS 4,555,990 A * 12/1985 Egawa ..... 108/20
6,655,534 B2 * 12/2003 Williams et al. ..... 211/26
6,666,340 B2 * 12/2003 Basinger et al. ..... 211/26
6,840,388 B2 * 1/2005 Mayer ..... 211/26
6,891,727 B2 * 5/2005 Dittus et al. ..... 361/724
6,935,521 B2 * 8/2005 Gundlach et al. ..... 211/183
7,192,103 B2 * 3/2007 Hamilton ..... 312/334.5
7,281,694 B2 * 10/2007 Allen et al. ..... 248/244
7,357,362 B2 * 4/2008 Yang et al. ..... 248/221.11
2003/0106863 A1 * 6/2003 Lauchner et al. ..... 211/26
2003/0213757 A1 * 11/2003 Rumney ..... 211/26
2007/0235402 A1 * 10/2007 Chen et al. ..... 211/192
2008/0296455 A1 * 12/2008 Brock et al. ..... 248/298.1
2009/0261699 A1 * 10/2009 Yu et al. ..... 312/334.46

* cited by examiner

*Primary Examiner*—J. Allen Shriver, II
*Assistant Examiner*—Nkeisha J Smith
(74) *Attorney, Agent, or Firm*—Rosenberg, Klein & Lee

(57) ABSTRACT

A slide mounting bracket structure includes a main bracket, an auxiliary bracket, a first engaging member, a second engaging member, an actuating element, a linking member and an elastic element. The main bracket is provided with the actuating element and the linking member at its inner side, and the auxiliary bracket is provided with the first engaging member and the second engaging member at its outer side. The actuating element corresponds to the first engaging member. The linking member has a part penetrating the main bracket, and has a support stand corresponding to the second engaging member, which further drags the auxiliary bracket to engage in sliding, and brings a second folded plate to depart from a first folded plate.

10 Claims, 11 Drawing Sheets

SLIDE MOUNTING BRACKET STRUCTURE

BACKGROUND OF THE INVENTION

1. Field of the Invention

The present invention relates to a slide mounting bracket structure, particularly to an auxiliary bracket that is capable of sliding relatively to a main bracket, which frees the tools for the attachment and removal of the slide promptly with respect to a rack.

2. Description of the Prior Art

A handy mounting of a bracket integrated with a slide to a metal rack is frequently viewed in the rack-mounted computer system.

This category of the slide brackets, are quite copious in their designs; however, the leading trends recently come in features of tool-less and prompt mounting and demounting, such as U.S. Pat. Nos. 6,891,727 B2 and 7,192,103 B2.

The foregoing disclosed prior art are focusing on a "sliding bracket" technique. In the U.S. Pat. No. 6,891,727 B2, once a mounting bracket is setup, the demounting of it can only be approached from its lateral, which means it would possibly be hard to demount a single slide and bracket of a server from arrays of slides and brackets of servers. The U.S. Pat. No. 7,192,103 B2 patent features a dismount of bracket at the front of the slide. Unfortunately, the prior art exhibits a complexity and enormity in its structure.

SUMMARY OF THE INVENTION

The present invention is to provide a slide mounting bracket structure, wherein the main bracket is provided with an actuating element and a linking member while the auxiliary bracket is provided with a first engaging member and a second engaging member, such that the auxiliary bracket is slidably coupled with the main bracket. It is also to dispose of the problems about unlocking during the dismount of the bracket. Another objective is to simplify the device elements and to diminish its size.

According to the present invention, there is provided a slide mounting bracket structure, comprising:

- a main bracket, provided with an opening and longitudinal troughs, and a first folded plate being located at a front end thereof;
- an auxiliary bracket, provided with a slot, and a second folded plate being located at a front end thereof, slidably coupled to an outer side of the main bracket and being subject to elastic force by an elastic element;
- a first engaging member, located on an outer side of the auxiliary bracket, having a snatch corresponding to the opening of the main bracket;
- a second engaging member, located on the outer side of the auxiliary bracket, having a hitch lodging in the slot of the auxiliary bracket and corresponding to the longitudinal troughs of the main bracket;
- an actuating element, located on an inner side of the main bracket, corresponding to the opening of the main bracket and the first engaging member; and
- a linking member, located on the inner side of the main bracket, corresponding to the longitudinal troughs of the main bracket and having a part penetrating the longitudinal troughs of the main bracket, a support stand being provided in the slot of the auxiliary bracket, the support stand corresponding to the second engaging member.

Preferably, the actuating element and the first engaging member are resilient, the actuating element being provided with a bulge corresponding to a snatch of the first engaging member, the bulge and the snatch corresponding to the opening of the main bracket.

Preferably, linking member comprises a push element and the support stand comprises a limb, the limb penetrating the longitudinal troughs of the main bracket and connecting to the push element.

Preferably, the longitudinal troughs of the main bracket have a blocking section which corresponds to the hitch of the second engaging member.

Preferably, the hitch of the second engaging member is provided with a tilt edge.

Preferably, the support stand is provided with a tilt corresponding to the tilt edge of the hitch of the second engaging member.

Preferably, the tilt of the support stand is made by the folding of an extended plate of the support stand.

Preferably, a raised slice is provided at an inner side of the slot and the support stand is provided with a stopper corresponding to the raised slice.

Preferably, the main bracket is provided with clamps and the auxiliary bracket is provided with chutes corresponding to the clamps, the auxiliary bracket further having a hook, the elastic element having two ends connecting to one of the clamps and the hook, respectively.

Preferably, the first folded plate and the second folded plate are provided with through holes and hanging poles respectively, the second folded plate having a nut.

Accordingly, the improved feature and advantage of the present invention are as follows:

a minimized structure in a limited space operates in an optimized way, which substantially boosts the value of the fitting of the apparatus.

DETAILED DESCRIPTION OF THE PREFERRED EMBODIMENT

Figure 1:
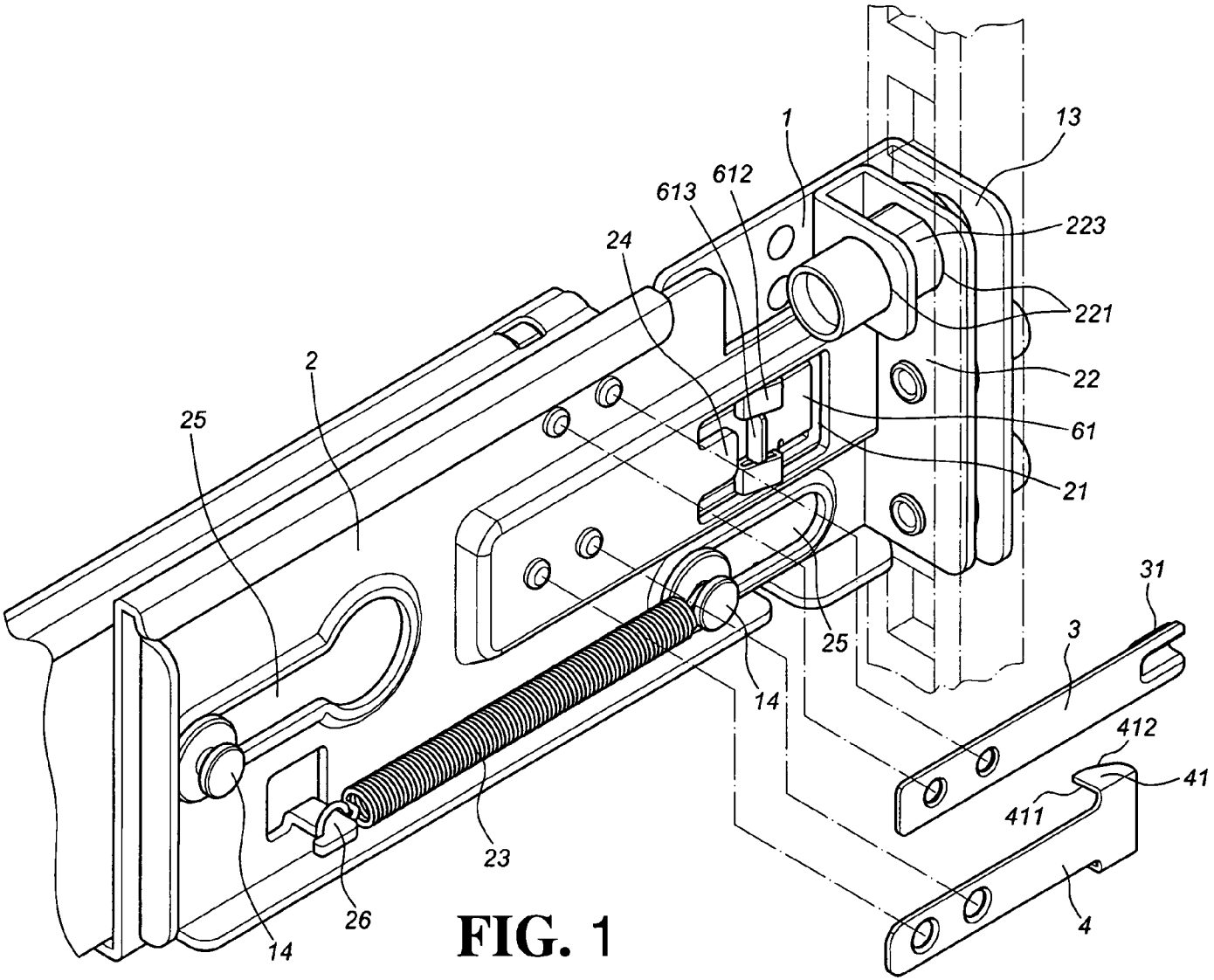
FIG. 1 depicts the first of a three-dimensional diagram of the present invention (the exploded illustration of a first engaging member and a second engaging member viewed from the outside)
Figure 2:
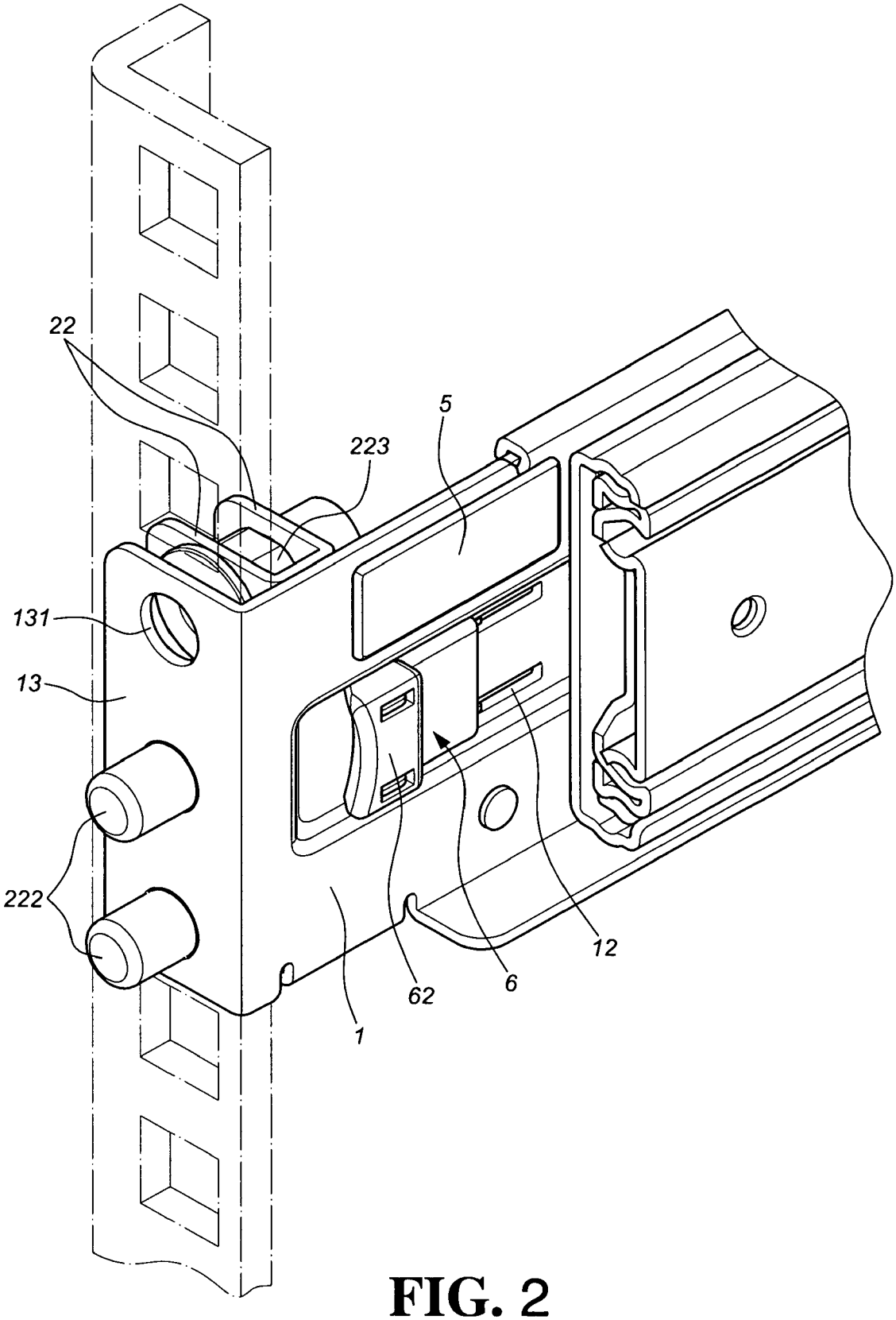
FIG. 2 depicts the second of a three-dimensional diagram of the present invention (viewed from the inside)
Figure 3:
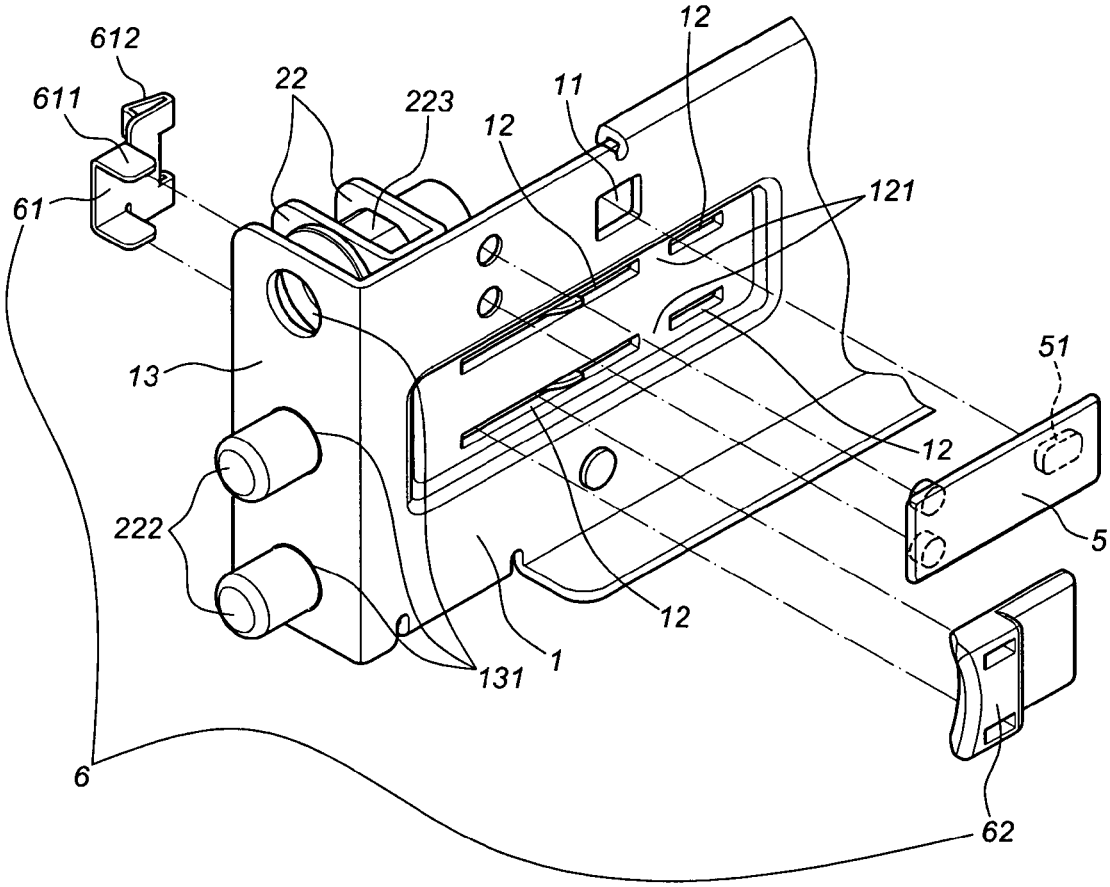
FIG. 3 depicts exploded view of a main bracket, an actuating element and a linking member of the present invention.

Please refer to FIGS. 1-3, which are three-dimensional diagrams of a preferred embodiment of the present invention, viewed from the outside and inside respectively, comprising a main bracket 1, an auxiliary bracket 2, a first engaging member 3, a second engaging member 4, an actuating element 5, and a linking member 6.

The main bracket 1 is provided with an opening 11, longitudinal troughs 12, a first folded plate 13 and clamps 14. Each longitudinal trough 12 has a blocking section 121. The first folded plate 13 is located at a front end of the main bracket 1 and provided with through holes 131.

Figure 4:
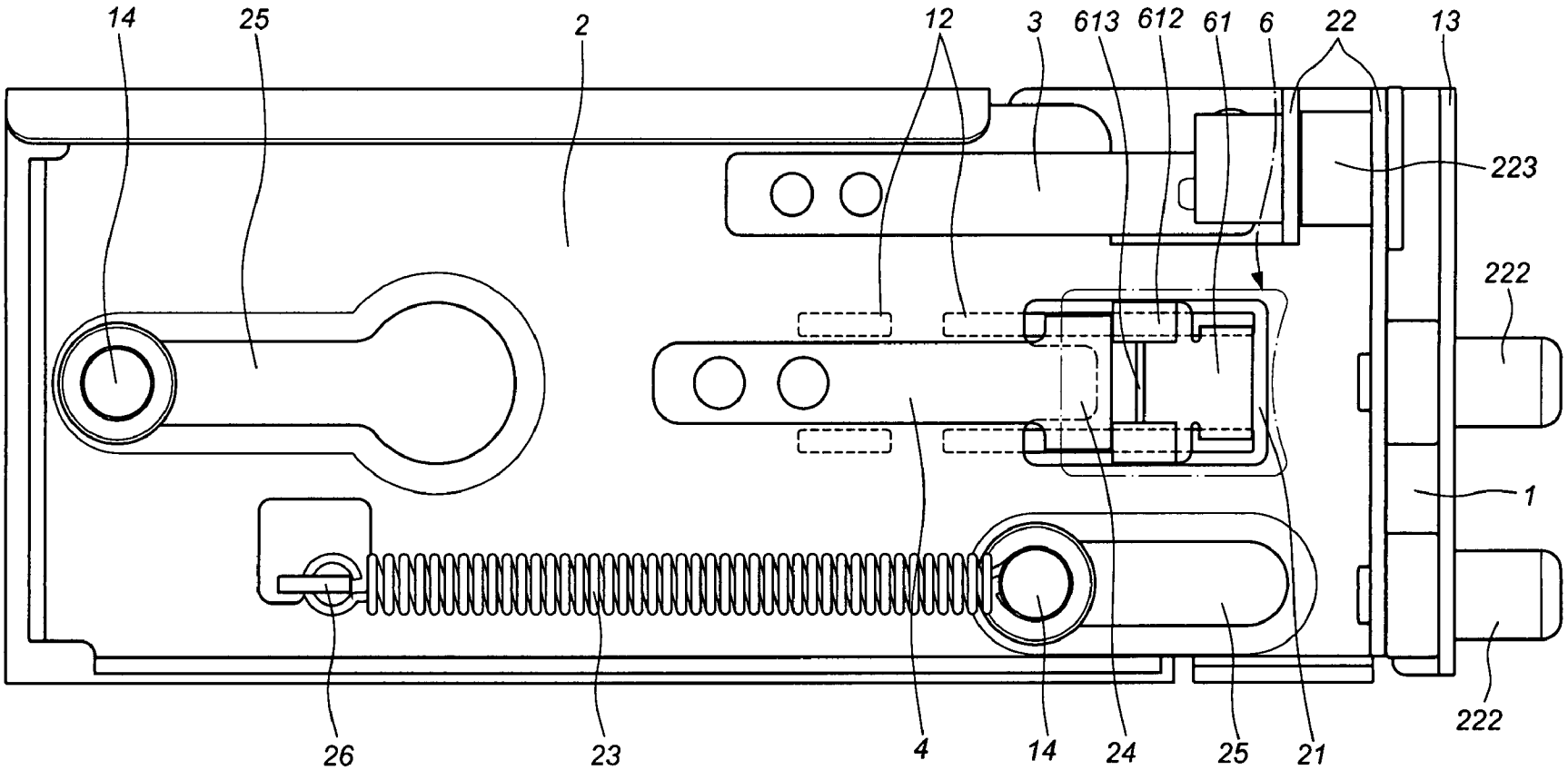
FIG. 4 depicts side view of the present invention (viewed from the outside)

The auxiliary bracket 2, referring to FIG. 4, is provided with a slot 21, a second folded plate 22, an elastic element 23, a raised slice 24, chutes 25 and a hook 26. The second folded plate 22 is located at a front end of the auxiliary bracket 2. The auxiliary bracket 2 is slidably coupled to the main bracket 1 at its outer side, and the sliding of the auxiliary bracket 2 is exerted by the elastic force of the elastic element 23. The raised slice 24 is disposed at the inner side of the slot 21. The chutes 25 connect with the clamps 14. The elastic element 23 has its both ends connected to one of the clamps 14 and the hook 26. The second folded plate 22 is provided with through holes 221, hanging poles 222 and a hut 223. The hanging poles 222 and the nut 223 correspond in position to the through holes 131 of the first folded plate 13.

The first engaging member 3, located on the outer side of the auxiliary bracket 2 and being resilient, is provided with a snatch 31 corresponding to the opening 11 of the main bracket 1.

Figure 6:
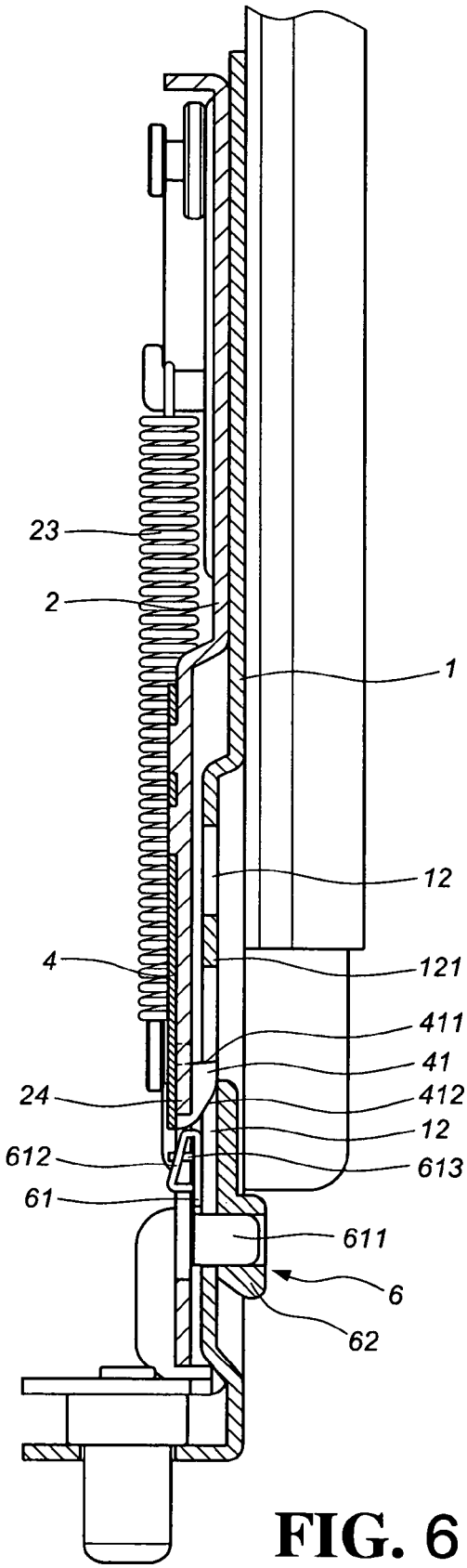
FIG. 6 is a partially sectional view of the second engaging member and the actuating element of the present invention.

The second engaging member 4, referring to FIG. 6, is located on the outer side of the auxiliary bracket 2, and is provided with a hitch 41. The hitch 41 has a vertical edge 411 and a tilt edge 412. The hitch 41 is stretched into the slot 21 of the auxiliary bracket 2 corresponding to the longitudinal troughs 12 of the main bracket 1. The vertical edge 411 of the hitch 41 corresponds to the blocking section 121 of the longitudinal troughs 12.

Figure 5:
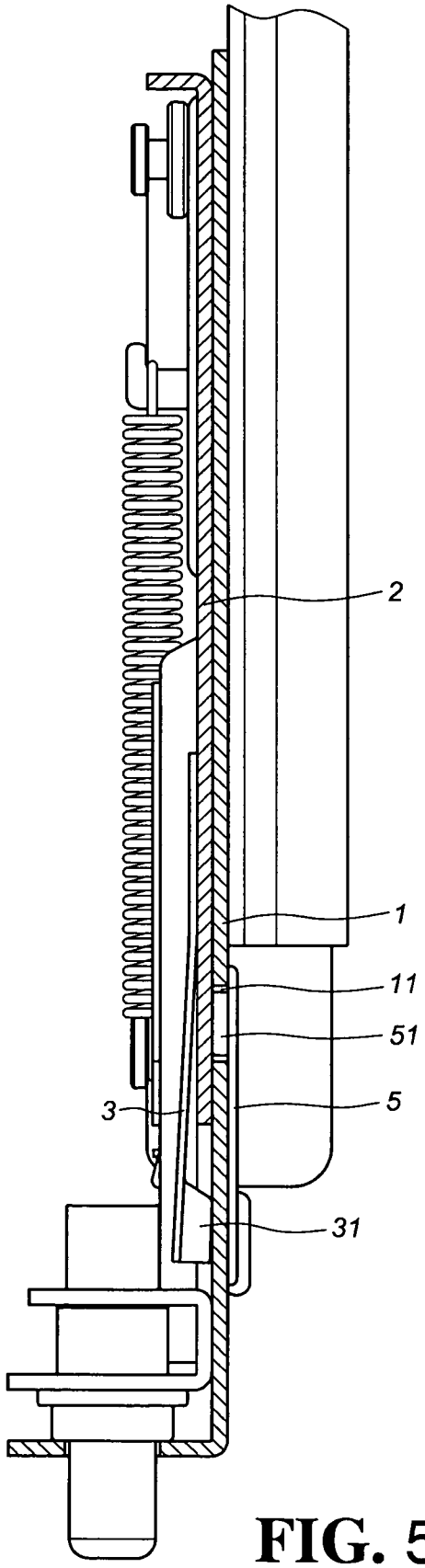
FIG. 5 is a partially sectional view of the first engaging member and the actuating element of the present invention.

The actuating element 5, referring to FIG. 5, located on the inner side of the main bracket 1 and being resilient, corresponds to the first engaging member 3. The actuating element 5 is provided with a bulge 51 which penetrates the opening 11 and engages with the snatch 31 of the first engaging member 3.

The linking member 6 comprises a support stand 61 and a push element 62. The support stand 61 is provided with limbs 611, a tilt 612 and a stopper 613. Referring to FIG. 6, the support stand 61 is located in the slot 21 of the auxiliary bracket 2 and corresponds to the longitudinal troughs 12 of the main bracket 1. The limbs 611 penetrate partially the longitudinal troughs 12 of the main bracket 1 and connect to the push element 62 at the inner side of the main bracket 1, which enable the support stand 61 to correspond to the second engaging member 4. The tilt 612 of the support stand 61 corresponds to the tilt edge 412 of the hitch 41 of the second engaging member 4. The tilt 612 of the support stand 61 is made by the folding of an extended plate of the support stand 61. The stopper 613 of the support stand 61 corresponds to the raised slice 24 of the auxiliary bracket 2.

Figure 7:
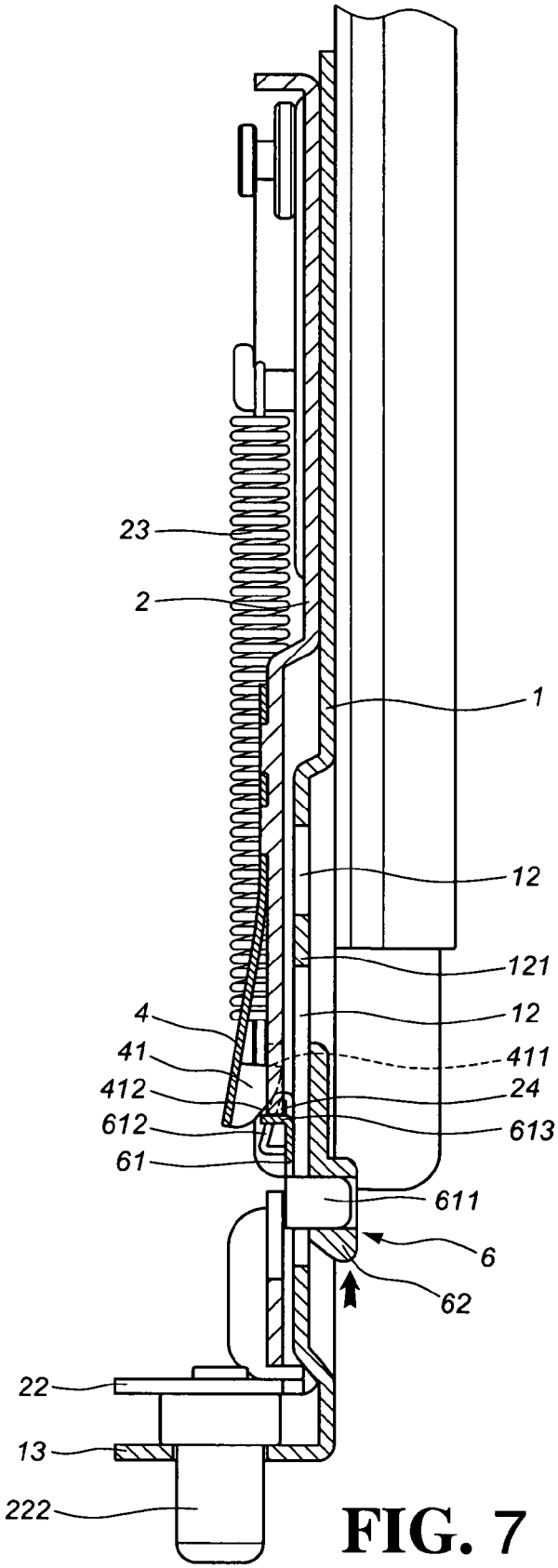
FIG. 7 is an operational schematic diagram of the unlocking of the second engaging member of the present invention.
Figure 8:
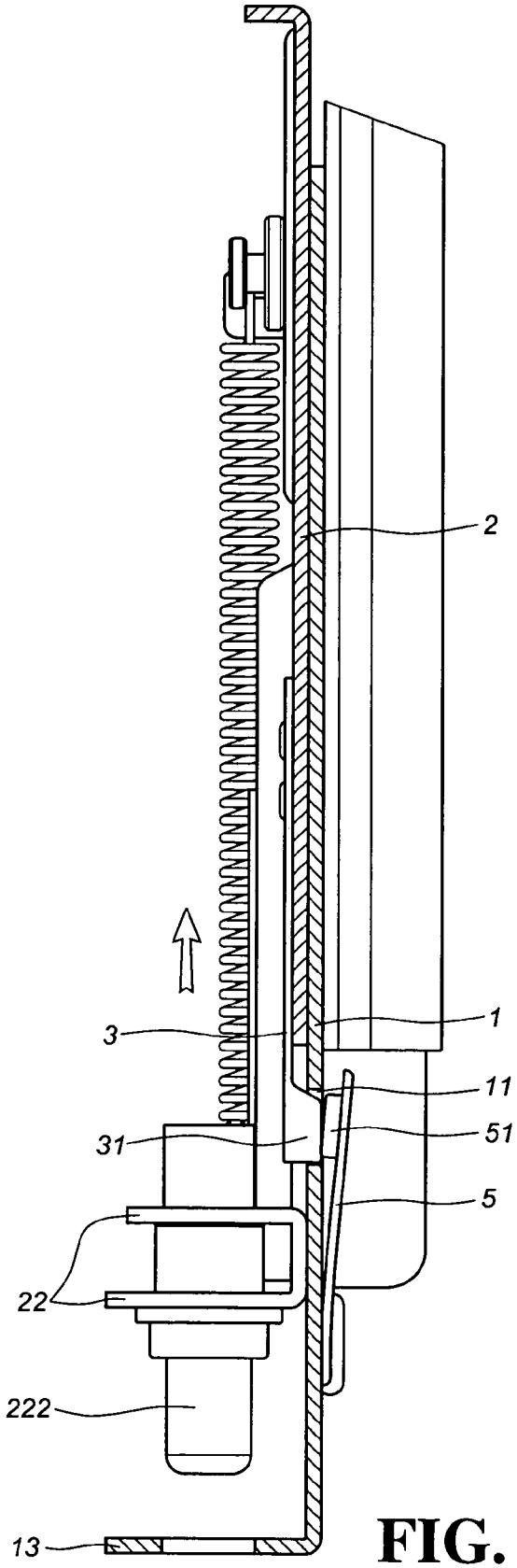
FIG. 8 is a schematic diagram of the locking of the first engaging member of the present invention.
Figure 9:
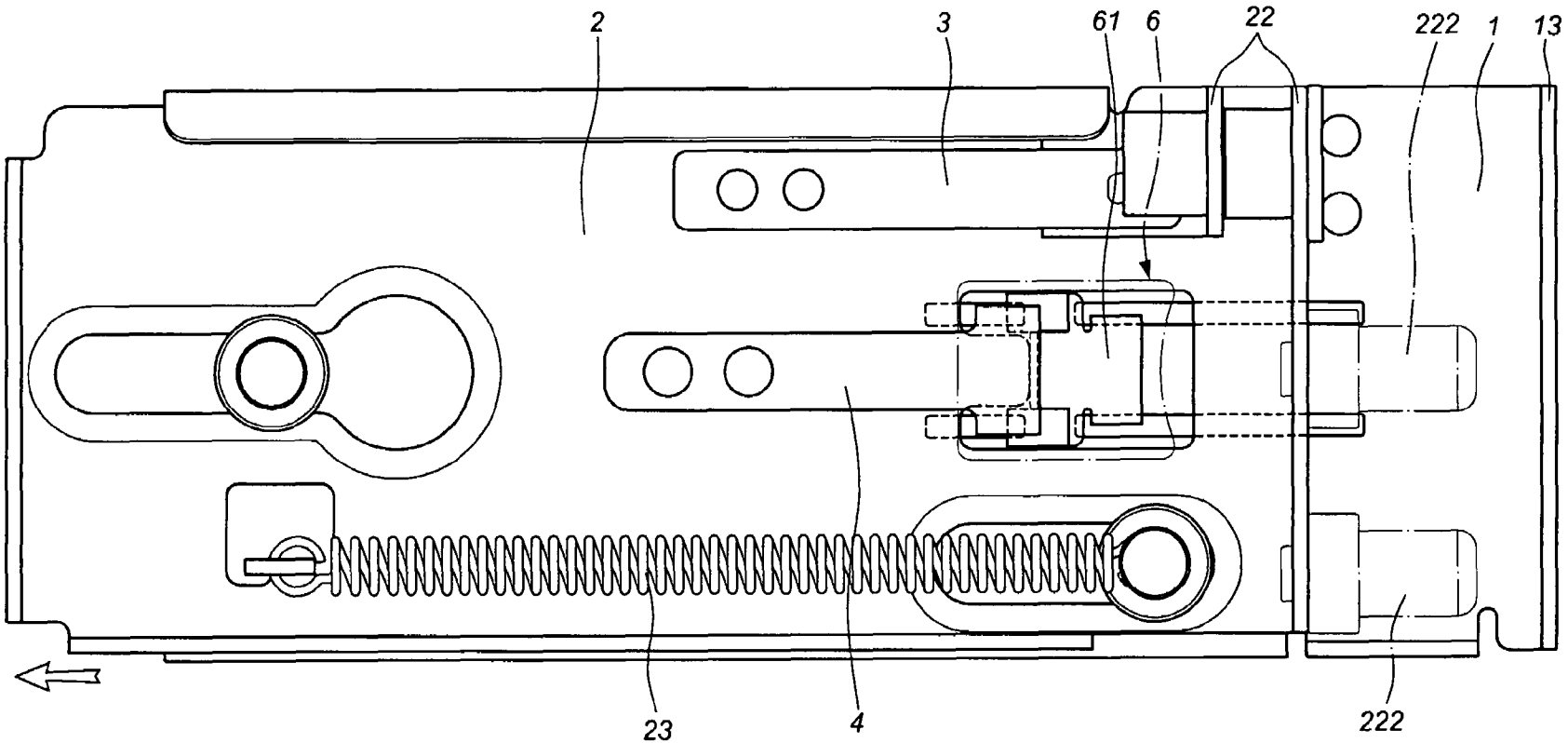
FIG. 9 is an operational schematic diagram of the disengagement of the auxiliary bracket of the present invention.

During operation, shown in FIG. 7, when the push element 62 of the linking member 6 is pressed, the tilt 612 of the support stand 61 will push the tilt edge 412 of the hitch 41 of the second engaging member 4 to drive the vertical edge 411 of the hitch 41 into a protrusion, no longer pressing the blocking section 121 of the longitudinal troughs 12. The stopper 613 of the support stand 61 is then used to press the raised slice 24 of the auxiliary bracket 2, such that the auxiliary bracket 2 is sliding relatively to the main bracket 1, until it is pushed in place. As shown in FIGS. 8 and 9, the snatch 31 of the first engaging member 3 is embedded in the opening 11 of the main bracket 1, followed by pressing the bulge 51 of the actuating element 5, to position the auxiliary bracket 2 temporarily. The distance between the second folded plate 22 of the auxiliary bracket 2 and the first folded plate 13 of the main bracket 1 is hence widened, and there is a gap between the hanging poles 222 and the first folded plate 13, which enables a handy dismount from a rack.

Figure 10:
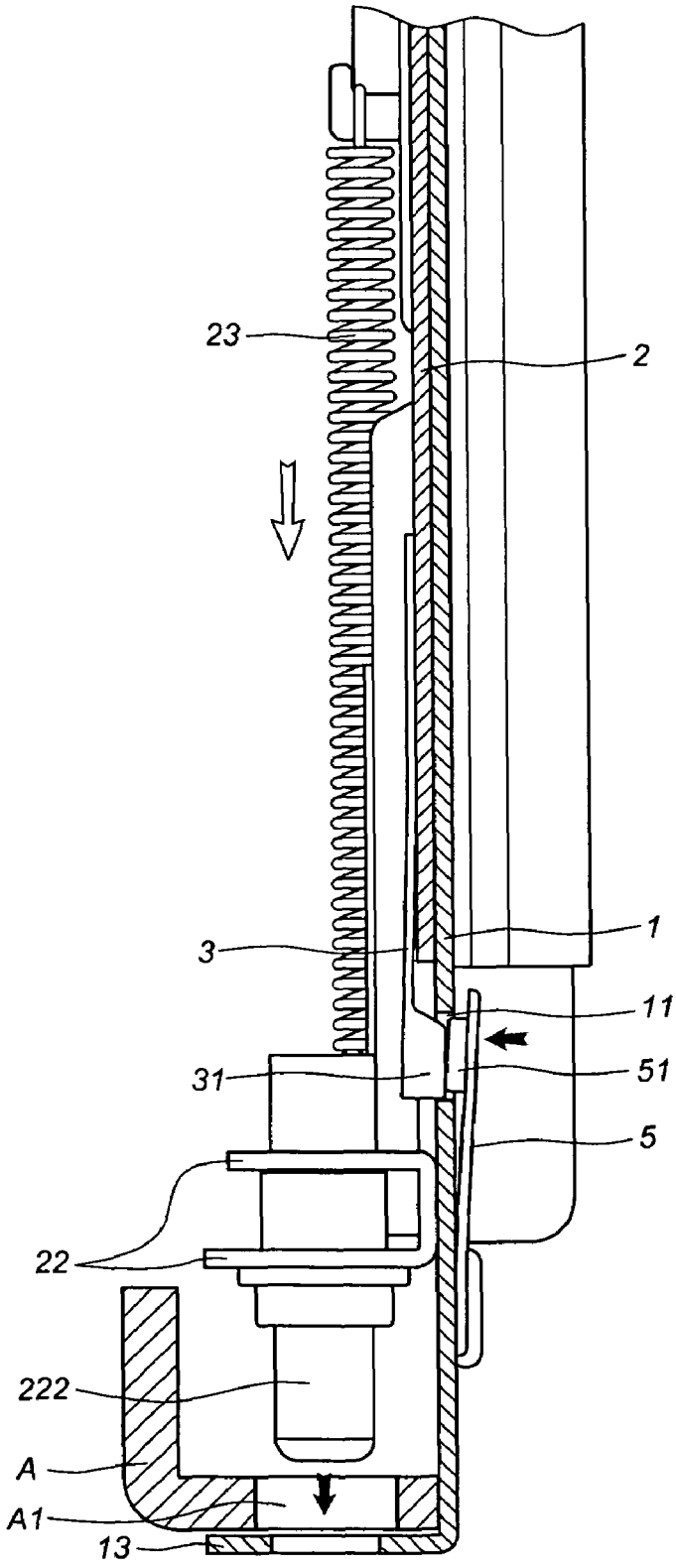
FIG. 10 is a schematic diagram of the unlocking of the first engaging member of the present invention.

Reversely, to attach again, once the main bracket 1 and the auxiliary bracket 2 are aligned with a mounting hole A1 of the rack A, referring to FIG. 10, as the actuating element 5 is pressed, the bulge 51 is responded by pushing the snatch 31 out from the opening 11, which results in an unlock of the first engaging member 3, and the elastic element 23 drags back the auxiliary bracket 2, where the main bracket 1 and the auxiliary bracket 2 are then in place with the rack A.

Figure 11:
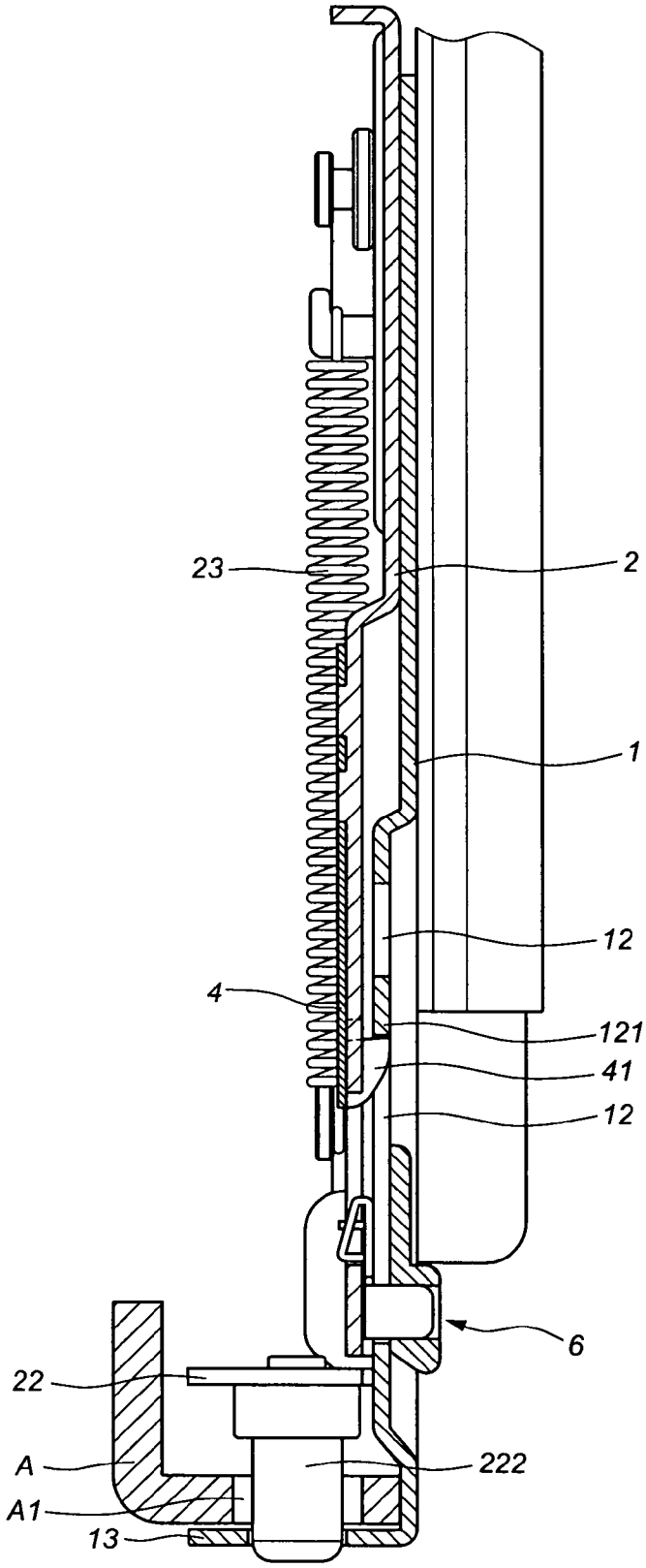
FIG. 11 is a schematic diagram of the confinement for the sliding of the auxiliary bracket of the present invention.

As shown in FIG. 11, the main bracket 1 and the auxiliary bracket 2 are ready placed in the rack A without a fastening (that is a screw penetrating the through hole 131 of the first folded plate 13 and locking to the nut 223 on the second folded plate 22), referring to FIG. 2. Even the auxiliary bracket 2 is forced to stretch the elastic element 23 such that the second folded plate 22 departs from the first folded plate 13. The hitch 41 of the second engaging member 4 lodges in the blocking section 121 of the longitudinal troughs 12 of the main bracket 1. The hanging poles 222 of the second folded plate 22 will not escape from the first folded plate 13 and the mounting hole A1 of the rack A, which disables the main bracket 1 and the auxiliary bracket 2 to depart easily from the rack A.

What is claimed is:

1. A slide mounting bracket structure, comprising:

a main bracket, provided with an opening and longitudinal troughs, and a first folded plate being located at a front end thereof;

an auxiliary bracket, provided with a slot, and a second folded plate being located at a front end thereof, slidably coupled to an outer side of the main bracket being subject to elastic force by an elastic element;

a first engaging member, located on an outer side of the auxiliary bracket, having a snatch corresponding to the opening of the main bracket;

a second engaging member, located on the outer side of the auxiliary bracket, having a hitch lodging in the slot of the auxiliary bracket and corresponding to the longitudinal troughs of the main bracket;

an actuating element, located on an inner side of the main bracket, corresponding to the opening of the main bracket and the first engaging member; and a linking member, located on the inner side of the main bracket, corresponding to the longitudinal troughs of the main bracket and having a part penetrating the longitudinal troughs of the main bracket, a support stand being provided in the slot of the auxiliary bracket, the support stand corresponding to the second engaging member.

2. The slide mounting bracket structure as in claim 1, wherein the actuating element and the first engaging member are resilient, the actuating element being provided with a bulge corresponding to a snatch of the first engaging member, the bulge and the snatch corresponding to the opening of the main bracket.

3. The slide mounting bracket structure as in claim 1, wherein the linking member comprises a push element and the support stand comprises a limb, the limb penetrating the longitudinal troughs of the main bracket and connecting to the push element.

4. The slide mounting bracket structure as in claim 1, wherein the longitudinal troughs of the main bracket have a blocking section which corresponds to the hitch of the second engaging member.

5. The slide mounting bracket as in claim 1, wherein the hitch of the second engaging member is provided with a tilt edge.

6. The slide mounting bracket structure as in claim 1, wherein the support stand is provided with a tilt corresponding to the tilt edge of the hitch of the second engaging member.

7. The slide mounting bracket structure as in claim 6, wherein the tilt of the support stand is made by the folding of an extended plate of the support stand.

8. The slide mounting bracket structure as in claim 1, wherein a raised slice is provided at an inner side of the slot and the support stand is provided with a stopper corresponding to the raised slice.

9. The slide mounting bracket structure as in claim 1, wherein the main bracket is provided with clamps and the auxiliary bracket is provided with chutes corresponding to the clamps, the auxiliary bracket further having a hook, the elastic element having two ends connecting to one of the clamps and the hook, respectively.

10. The slide mounting bracket structure as in claim 1, wherein the first folded plate and the second folded plate are provided with through holes and hanging poles respectively, the second folded plate having a nut.

* * * * *